United States Patent [19]

Emrich

[11] 4,326,348

[45] Apr. 27, 1982

[54] EXCAVATING TOOTH ASSEMBLY

[75] Inventor: Robert K. Emrich, Portland, Oreg.

[73] Assignee: ESCO Corporation, Portland, Oreg.

[21] Appl. No.: 173,769

[22] Filed: Jul. 30, 1980

[51] Int. Cl.[3] ..... E02F 9/28

[52] U.S. Cl. ..... 37/142 R; 172/719

[58] Field of Search ..... 37/142 R, 142 A, 141 R, 37/141 T; 172/719, 701.3

[56] References Cited

U.S. PATENT DOCUMENTS

| | | | |
|---|---|---|---|
| 1,507,697 | 9/1924 | Crane | 37/142 R |
| 2,896,345 | 7/1959 | Peklay | 37/142 R |
| 3,082,555 | 3/1963 | Hill | 37/142 R |
| 3,536,147 | 10/1970 | Norton | 37/142 R X |
| 3,601,911 | 8/1971 | Wood | 37/142 |
| 3,851,413 | 12/1974 | Lukavich | 37/142 R X |
| 4,231,173 | 11/1980 | Davis | 37/142 R |

*Primary Examiner*—E. H. Eickholt

*Attorney, Agent, or Firm*—Tilton, Fallon, Lungmus & Chestnut

[57] ABSTRACT

An excavating tooth assembly including an adapter, a wear cap for the adapter and a point in which the point and adapter have primary cooperating stabilizing surfaces and in which the point and wear cap have secondary cooperating stabilizing surfaces.

27 Claims, 11 Drawing Figures

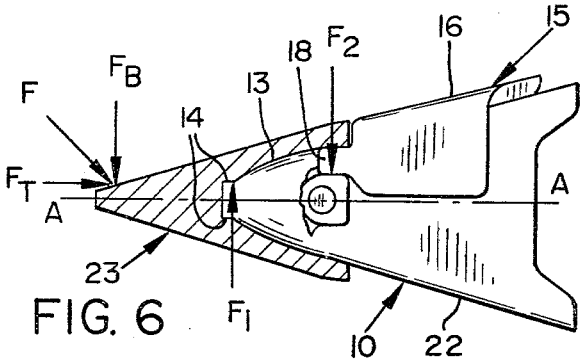
FIG. 6
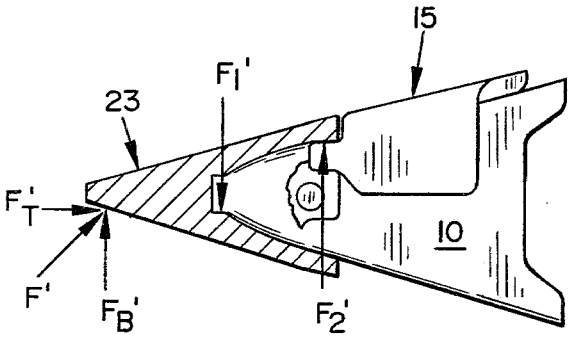
FIG. 7
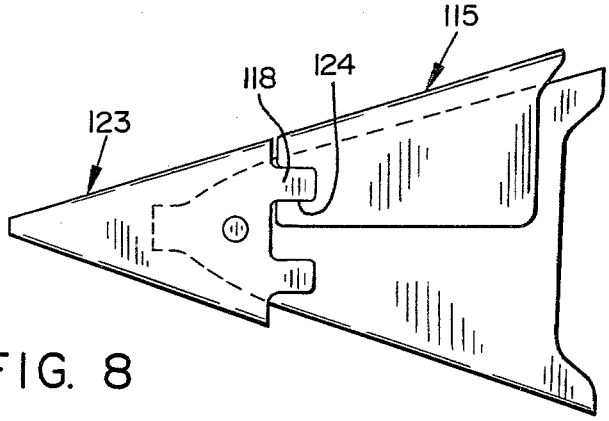
FIG. 8
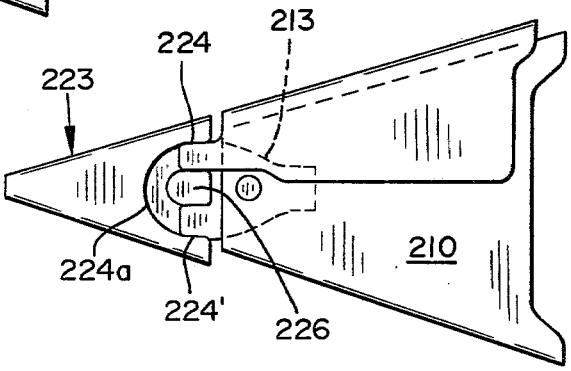
FIG. 9
FIG. 10
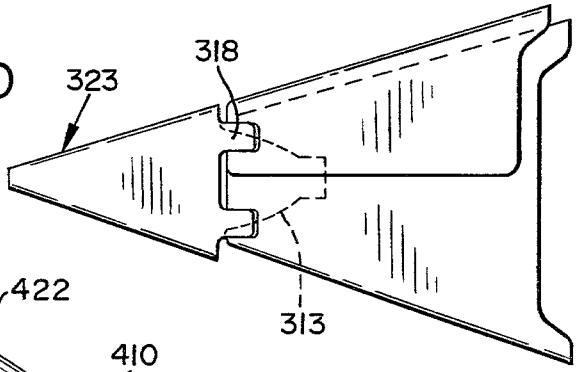
FIG. 11
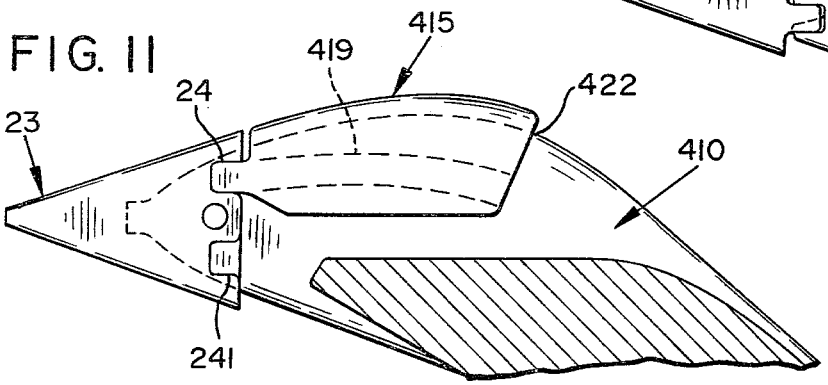

EXCAVATING TOOTH ASSEMBLY

BACKGROUND AND SUMMARY OF INVENTION

This invention relates to an excavating tooth assembly and, more particularly, in which an assembly consisting of point, adapter and wear cap has a unique stabilizing relationship between the elements so as to resist heavy forces.

Since the turn of the century, the practice in the excavating art has been to employ excavating teeth with replaceable tips known as "points". By replacing the points on the adapter from time to time, the penetrating ability is maintained. Often, an adapter will outlast five or more replacement points.

With the frequency of replacement, this necessitated the provision of releasable locking means and, for many years, the locks were staunch in order to withstand the forces tending to draw the point off of the adapter. For the most part, the adapter was equipped with a wedge shaped, forwardly extending nose received within a correspondingly contoured socket at the rear of the point. In order to mitigate the stresses on the locking pin (which generally extended vertically through aligned openings in the point and adapter nose), the phenomenon of secondary stabilization was employed. This was featured in U.S. Pat. No. 2,483,032 and achieved through the provision of rearwardly extending tongues or ears on the point which made it within corresponding recesses in the adapter. Thus, a loading on the end of the point would cause pivotal movement of the point on the adapter nose and bring secondary surfaces, i.e., those other than the confronting faces of the socket and nose, into engagement.

Although this type of stabilization was effective for many years in two-part teeth, a vastly superior type of stabilization was taught in U.S. Pat. No. 3,079,710. An important feature in that patent was the provision of stabilizing surfaces at the apex of the nose and socket on opposite sides of the longitudinal axis of the tooth, i.e., the path of movement in installing the point on the adapter. This principle of operation of the stabilized tooth of the '710 patent involved longitudinally spaced pairs of bearing surfaces so as to uniquely resist point-removal forces. It will be appreciated that even a pure beam loading, i.e., a vertical force, would develop a forward component in the ordinary tooth extending parallel to the associated wedge faces on the nose and socket—thereby developing a negative thrust tending to remove the point from the adapter.

Although this principle has functioned quite satisfactorily for almost 20 years, it never was used to advantage in teeth equipped with wear caps. It will be appreciated that although the point can be replaced from time to time, the upper surface of the adapter is subject to almost as much wear as the point—as by virtue of the earth passing thereover and developing an abrading action. An early version of a wear plate or cap for an adapter is seen in U.S. Pat. No. 1,918,841. Over the years various forms of wear caps were provided to cover the upper surfaces of the adapter such as those seen in U.S. Pat. Nos. 2,762,139; 2,896,345; 3,020,655 and 3,082,555. However, in all of these cases, there was no cooperative action between the point and wear cap—except the normally expected cooperation of the point serving to hold the wear cap in place—and this only in certain instances. In other words, the point had to be removed from the adapter before the wear cap could be removed from the adapter.

According to the invention, a novel cooperation is provided between the wear cap and point wherein these two elements function to provide secondary stabilization. In the preferred embodiment, the wear cap is equipped with forwardly extending tongues which are received within correspondingly contoured recesses in the point rear and which serve the purpose of secondary stabilization. No analogous teaching has been found in the art. The concept of providing recesses in the point rear to receive tongues (as from the adapter) has been known for many years—see U.S. Pat. No. 1,845,677. More recently, a point was equipped with a hook-shaped notch to receive a corresponding hook on something akin to a wear cap, i.e., a ripper shroud as seen in U.S. Pat. No. 3,999,614. However, this type of locking engagement was well known in the shroud art as seen in U.S. Pat. No. 3,621,594. In any event, there was no cooperation to provide stabilization of the form found advantageous in minimizing shearing stresses on the lock holding the point and adapter in assembled condition.

According to the invention, the point and adapter have primary bearing surfaces provided at the apex of the socket and nose. Although in accordance with established practice it is advantageous to have the socket in the nose (so as to minimize the amount of throw away metal), the nose and socket may be interchanged on the point and adapter. Thus, the means for coupling the point and adapter include a structure such as a nose or socket and the complement or negative thereto.

The above-mentioned bearing or stabilizing surfaces are disposed on opposite sides of the predetermined path of mounting, i.e., the tooth longitudinal axis. Further, the point has joint means in the form of a recess or tongue provided in the rear of each sidewall into which a forwardly extending tongue or rearwardly extending recess (i.e., the complement or negative) extends from the wear cap—thereby providing a secondary set of stabilizing surfaces. Advantageously, the tongues and recesses providing these secondary stabilizing surfaces are vertically offset from the longitudinal mounting axis and the preferred embodiment provides two sets of recesses in each point sidewall so as to render the point readily reversible. This also cuts down on the amount of throw-away metal when the point is to be replaced.

In the prior art tooth having rearwardly-existing tongues to provide secondary stabilization, the recesses in the adapter often became worn or "peened" because of the contact of the tongue therewith. This meant that as the adapter aged, poorer and poorer secondary stabilization was provided—even with the new points that were installed from time to time. Building up of the worn areas of the adapter was not an attractive alternative because of the difficulty of welding the special strength alloys, particularly in the field.

This then underscores another significant benefit of the invention—the ability to renew the stabilizing means independent of the adapter. Normally, the wear cap is replaced with every second point so that even over the prolonged life of the adapter, the joint means and complement thereto forming the secondary stabilizing surfaces are maintained in most effective condition by frequent renewal.

Other objects and advantages of the invention may be seen in the details of the ensuing specification.

DETAILED DESCRIPTION

The invention is described in conjunction with the accompanying drawing, in which FIG. 1 is a perspective view of a tooth embodying teachings of the invention;

FIGS. 6 and 7 are free body diagrams of the inventive tooth; and

FIGS. 8–11 are side elevational views of modified forms of teeth embodying the invention.

Figure 1:
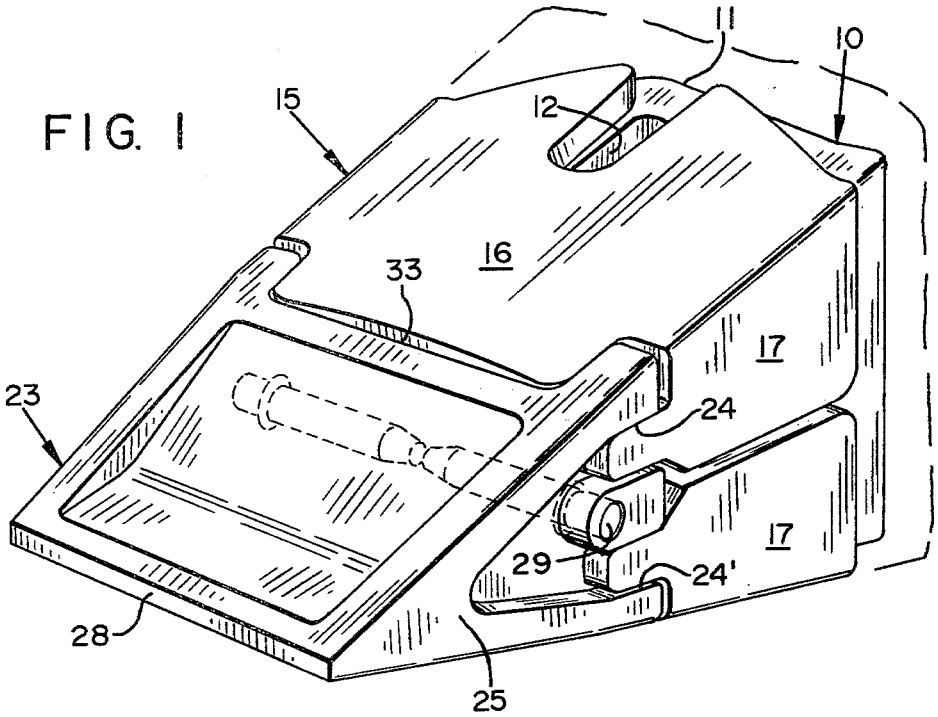
Figure 2:
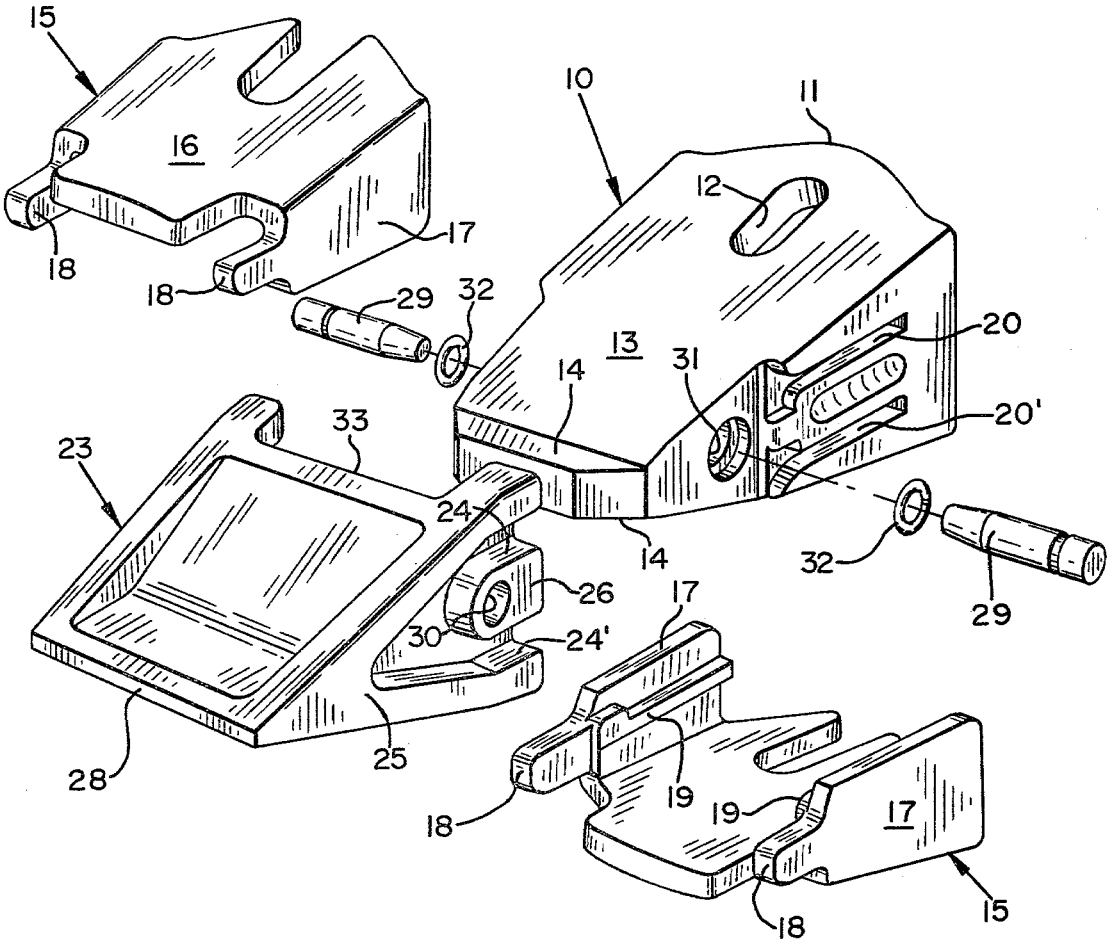
FIG. 2 is an exploded perspective view of the tooth of FIG. 1.
Figure 3:
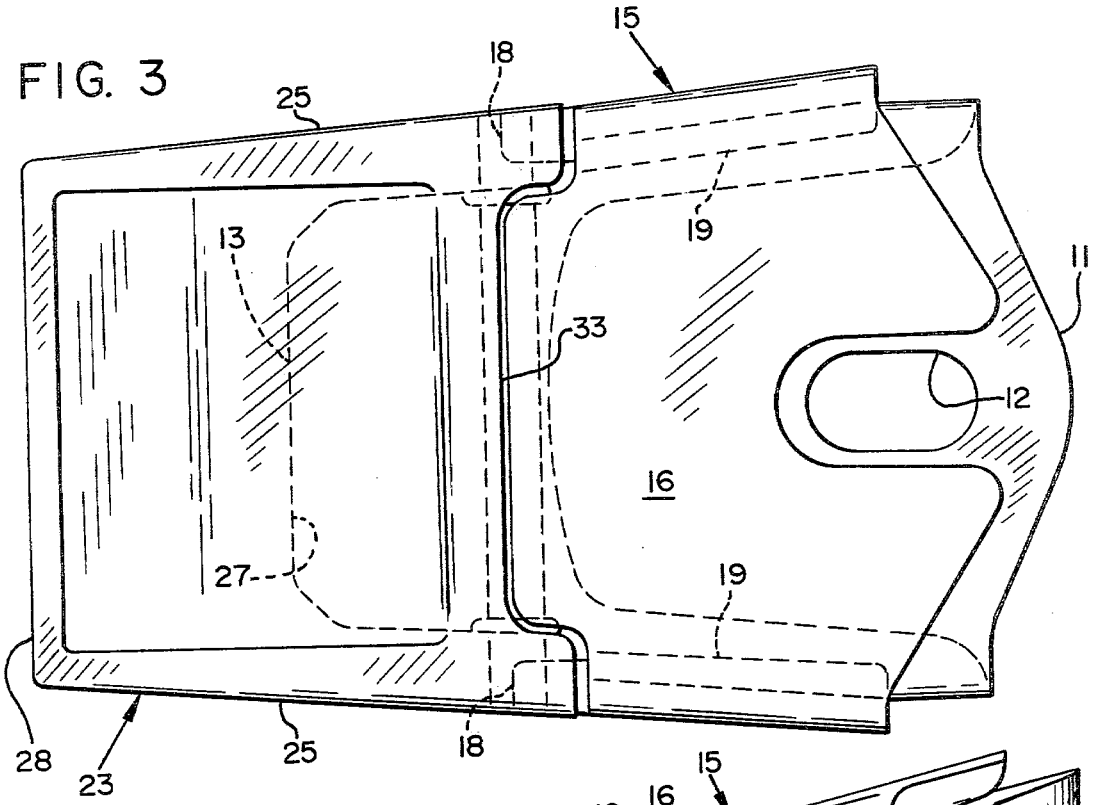
FIG. 3 is a top plan view of the tooth of FIG. 1.

In the illustration given and with reference to FIGS. 1 and 2, the numeral 10 designates generally an adapter. Adapters come in a variety of shank configurations depending upon the type of excavating equipment with which they are used. In any event, adjacent the rear end 11, the adapter is equipped with means in the form of a vertical bore 12 for the receipt of a pin lock for attaching the same to excavating equipment.

At the forward end, the adapter is equipped with nose means 13 which, in the illustrations given, is a generally wedge shaped nose. It will be appreciated that in some instances, the adapter may be equipped with a socket rather than the nose illustrated but the invention principles are equally applicable to both versions. The nose 13 is equipped with primary stabilizing surfaces as at 14 which, as can be appreciated from FIG. 6, are disposed on opposite sides of the longitudinal mounting axis AA.

The numeral 15 designates generally the wear cap which is normally installed first on the adapter 10. The wear cap 15, in the illustration given, has a top wall 16 and a pair of integral, depending sidewalls 17. The sidewalls 17 are extended forwardly to provide integral forwardly extending tongues 18. Interiorly of the sidewalls 17 and aligned with the tongues 18 are rails 19 which are received within slots or ways 20 provided on the adapter sidewalls. Thus, the wear cap is able to protect the top wall of the adapter by at least partially covering the same. In some instances it may be advantageous to protect the bottom wall 22 of the adapter 10 and for that purpose, a second slot 20' is provided. Thus, a second wear cap can be installed and the point generally designated 23 is equipped with a pair of recesses 24 and 24' in each sidewall 25 for this purpose. Such a bottom wear cap is especially useful in situations where "backslap" is encountered frequently. However, two wear caps are not necessary for proper operation.

Figure 5:
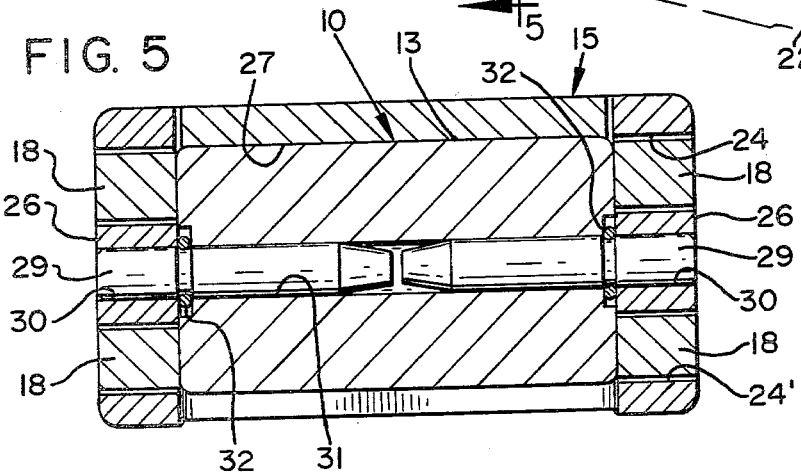
FIG. 5 is a sectional view taken along the line 5—5 of FIG. 4.

As can be appreciated from FIG. 2, the recesses 24 and 24' do not extend transversely through the entire sidewall 25 but only partially so that there is a substantial web of sidewall at the rear of the point to strengthen the box section. To develop the necessary bearing surfaces, a portion of the sidewall of the point adjacent the rear thereof is itself in the nature of a rearwardly extending tongue as at 26—see particularly FIG. 2. The interposition of the tongue 26 thus defines the two recesses 24 and 24'. The point 23 is equipped with a rearwardly facing socket 27 (see FIG. 5) and at its forward end is equipped with a penetrating edge or bit 28. The socket 27 has a continuous inner side wall 25 at the end because, as pointed out previously, the recesses 24 and 24' do not extend through the entire thickness of the sidewalls 25.

In the operation of the invention, a beam loading such as that indicated at $F_B$ in FIG. 6, if applied to the forward portion of the point 23 will result in an upward force $F_1$ on the upper primary stabilizing surface of the point (confronting the upper primary stabilizing surface 14 of the adapter nose and a downwardly directed force $F_2$ on the underside of the recess 24. It will be appreciated that forces applied to the teeth are normally not either parallel to or perpendicular to the longitudinal mounting axis AA but at some other angle. However, a component of any such force can be represented by $F_B$ and, it will be further appreciated that an upward vertical force as $F'_B$ in FIG. 7 bring into play reactions in the opposite stabilizing faces, i.e., the lower primary stabilizing surface as at F', and the upper secondary stabilizing surface as at $F'_2$. This is the situation normally encountered in "backslap".

Completing the assembly are pin locks generally designated 29 (see FIG. 2) which is adapted to be inserted through aligned openings 30 in the point 23 and 31 in the adapter nose 13. Also provided are locking rings 32 for the ends of the locking pins 29. With the provision of the dual sets of stabilizing surfaces according to the invention, the locking means 29 is substantially relieved of any shearing stress.

It will be noted in the illustration given that the elements 10, 15 and 23 are relatively elongated—this being the normal configuration. However, in some types of excavating machinery, it is desired to have very wide teeth so that in some instances the actual width dimension will be greater than that measured along the axis AA for any one or more of the given elements.

In the assembly of the invention, the wear cap 15 is installed on the adapter 10 by engaging the rails 19 with the slots 20 and moving the wear cap rearwardly parallel to the axis AA. Thereafter the point 23 is installed on the nose 13 by a similar rearward movement, this time along the axis AA, after which the pin locks 29 are installed and held in place by the rings 32. The point, in historic fashion, serves to maintain the wear cap in place on the adapter by providing a confronting wall as at 33 (see FIG. 1) as well as the engagement of the tongues with the walls defining the recesses 24.

Figure 4:
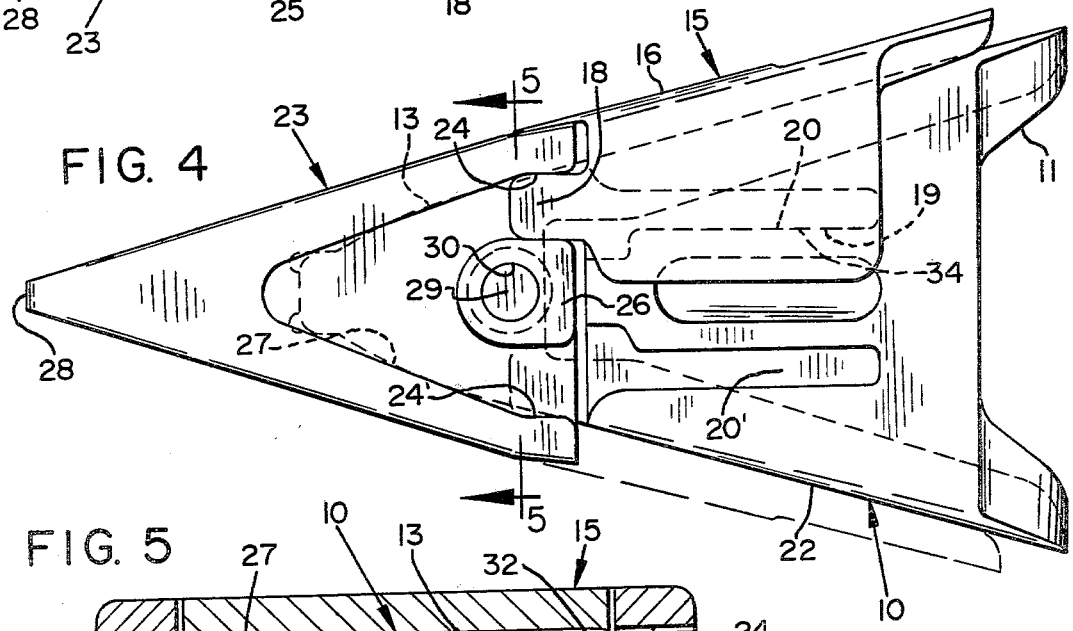
FIG. 4 is a side elevational view of the tooth of FIG. 1.

Through the provision of the rails 19 and slots 20, horizontal bearing surfaces are provided in the area designated 34 in FIG. 4 so that a substantial portion of the cap and the adapter (the portions above the bearing area 34) have to be worn away before earth passing over the wear cap can engage both sets of bearing surfaces and thus cause dislodgement of the wear cap.

Turning now to FIGS. 8–11, other forms of the invention can be seen wherein certain of the parts are interchanged. For example, relative to FIG. 8, the point 123 is equipped with rearwardly extending tongues 118 and the wear cap 115 is equipped with complementary shaped recesses as at 124.

In FIG. 9, yet another modification is seen and wherein the point 223 is equipped with a rearwardly extending nose 213 in place of the socket 27 of the embodiment pictured in FIGS. 1–7. In this embodiment, the adapter 210 is equipped with the socket (not designated). Additionally, the recesses 224 and 224' are connected as at **224*a* by virtue of joining the recesses in an arcuate path. This results in the development of a boss as at 226 rather than the tongue-like portion 26** of the first illustrated embodiment.

In FIG. 10, the point 323 is equipped with rearwardly extending tongues as at 318 in the manner illustrated with respect to FIG. 8 and also is equipped with a rearwardly extending nose as at 313 in the fashion already described with respect to FIG. 9.

In FIG. 11, the embodiment of FIGS. 1–7 is generally employed, i.e., a point generally designated 23. The point 23 is equipped with the recesses 24 and 24' as before. However, the adapter generally designated 410 is provided as an integral portion of the excavating equipment, i.e., the vertical bore 12 of the first illustrated embodiment is omitted. Also, because of some instances, it is advantageous to provide an arcuate earth engaging surface as at 422, the wear cap 415 is similarly contoured and equipped with an arcuate rail as at 419.

While in the foregoing specification, a detailed description of various embodiments of the invention has been set down for the purpose of illustration, it will be appreciated that many and further variations may be made in the details hereingiven without departing from the spirit and scope of the invention.

I claim:

1. A tooth assembly for earth working equipment comprising an adapter having top, bottom and side surfaces and means at the rear end thereof for projecting the same forwardly from said equipment and point coupling means at the forward end for receiving a point attachable on said adapter by movement along a predetermined axis, said point coupling means terminating in a pair of spaced apart stabilizing surfaces arranged on opposite sides of said axis, said adapter also having mounting means for supporting a wear cap on said top surface to protect said adapter against wear from earth passing thereover, a wear cap removably mounted on said adapter covering at least a portion of said top surface, said wear cap having at least one axially extending joint means, a point removably coupled to said adapter and having a bit at the forward end thereof and the complement to said coupling means at the rear end thereof, said complement to said coupling means terminating in a pair of spaced apart stabilizing surfaces arranged on opposite sides of said axis, said point having forwardly extending sidewalls, a complement to said joint means in at least one sidewall adapted to receive said joint means whereby said joint means and complement thereto cooperate with said stabilizing surfaces in resisting the beam component of externally applied forces on said point, and lock means releasably securing said point to said adapter.

2. The structure of claim 1 in which said joint means and complement thereto include tongue means and recess means.

3. The structure of claim 1 in which said joint means and complement thereto are provided in each point sidewall, spaced on opposite sides of said predetermined axis.

4. The structure of claim 3 in which a pair of said joint means are provided in each point sidewall, spaced on opposite sides of said predetermined axis.

5. The structure of claim 1 in which said joint means includes at least one recess in said point.

6. The structure of claim 1 in which said joint means includes at least one recess in said wear cap.

7. The structure of claim 1 in which said point is equipped with a socket constituting said coupling means.

8. The structure of claim 1 in which said point is equipped with a nose constituting said coupling means.

9. The structure of claim 1 in which said adapter is provided integral with said equipment.

10. A tooth assembly for earth working equipment comprising a relatively elongated adapter having top, bottom and side surfaces and means at the rear end thereof for attachment to said equipment and nose means at the forward end for receiving a point attachable on said adapter by movement along a longitudinal axis, said nose means terminating in a pair of spaced apart stabilizing surfaces arranged on opposite sides of said axis, said adapter also having mounting means for supporting a wear cap on said top surface to protect said adapter against wear from earth passing thereover, a wear cap removably mounted on said adapter covering at least a portion of said top surface, said wear cap having a pair of forwardly projecting tongues, a relatively elongated point removable mounted on said nose means having a bit at the forward end thereof and the complement to said nose means at the rear end thereof, said complement to said nose means terminating in a pair of spaced apart stabilizing surfaces arranged on opposite sides of said axis, said point having forwarding convergent top and bottom walls and generally vertically extending sidewalls, a recess in each sidewall adapted to receive one of said tongues whereby said tongues and recesses cooperate with said stabilizing surfaces and reacting to beam forces on said point, and lock means releasably securing said point to said adapter.

11. The structure of claim 10 in which said point recesses are each provided in vertically spaced relation to said mounting axis.

12. The structure of claim 11 in which a pair of recesses are provided in each point sidewall, spaced on opposite sides of said mounting axis.

13. The structure of claim 10 in which said adapter is equipped with mounting means for supporting a wear cap on said bottom surface.

14. A point for an excavating tooth comprising a unitary, metal body having forwardly convergent top and bottom walls terminating in a bit at the forward end of said point and generally vertical sidewalls, said point at the rear end being equipped with coupling means for mounting the point on an adapter by movement along a predetermined mounting axis, said coupling means having convergent top and bottom surfaces terminating in a pair of spaced apart stabilizing surfaces arranged on opposite sides of said axis, said sidewalls adjacent the rear end of the point being equipped with joint means for the receipt of complementary joint means associated with an adapter wear cap to provide cooperative stabilization with said stabilizing surfaces.

15. The structure of claim 14 in which said sidewall joint means are spaced vertically from said axis.

16. A point for an excavating tooth comprising a unitary, relatively elongated metal body having forwardly convergent top and bottom walls terminating in a bit at the forward end of said point and generally vertical sidewalls, said point at the rear end being equipped with socket means for mounting the point on an adapter by movement along a longitudinal mounting axis, said socket means having convergent top and bottom surfaces terminating in a pair of spaced apart stabilizing surfaces arranged on opposite sides of said axis, said sidewalls adjacent the rear end of said point being equipped with recesses for the receipt of tongues associated with an adapter wear cap to provide cooperative stabilization with said stabilizing surfaces.

17. The structure of claim 16 in which said sidewall recesses are spaced vertically from said axis.

18. The structure of claim 17 in which each sidewall is equipped with a pair of recesses spaced on opposite sides of said axis.

19. A point for an excavating tooth comprising a unitary metal body having forwardly convergent top and bottom walls terminating in a bit at the forward end of said point and generally vertical sidewalls, said point at the rear end being equipped with a socket for mounting the point on an adapter by movement along a longitudinal mounting axis, said socket having convergent top and bottom surfaces terminating in a pair of spaced apart stabilizing surfaces arranged on opposite sides of said axis, each of said sidewalls adjacent the rear end of said point being equipped with a pair of vertically spaced apart recesses for the receipt of tongues associated with an adapter wear cap to provide cooperative stabilization with said stabilizing surfaces.

20. A point for an excavating tooth comprising a generally wedge-shaped body providing forwardly convergent top and bottom walls and generally vertical sidewalls, said top and bottom walls terminating in a bit at the forward end of said point and said point at the rear end thereof being equipped with a socket for the receipt of an adapter nose, said socket having an apex providing a pair of generally parallel stabilizing surfaces arranged on opposite sides of the axis of mounting the point on the adapter, said point sidewalls each being equipped with a recess extending forwardly from the rear end thereof for the receipt of a tongue associated with an adapter cap to provide cooperative stabilization with said stabilizing surfaces.

21. The structure of claim 20 in which each recess is vertically offset from said axis.

22. The structure of claim 20 in which said recess is provided only in the outer surface of said sidewalls thereby providing a web to constitute a complete box section at the rear of said point.

23. The structure of claim 20 in which said sidewalls are equipped with aligned openings for the receipt of locking means.

24. A wear cap for an excavating tooth adapter comprising a unitary metal body having a plate-like portion adapted to cover a generally horizontal wear surface of an adapter and couplable to said adapter by rearward movement along a predetermined path generally parallel to the longitudinal mounting axis employed in mounting a point on said adapter, said plate-like portion being equipped with integral vertical flanges along the sides thereof with each flange being equipped with coupling means for engagement with the complement thereof on said adapter during said rearward movement, said flanges at the forward end thereof being equipped with joint means for engagement with complements thereof in the rear of said point for stabilizing said point on said adapter and resisting the beam component and externally applied forces on said point.

25. The structure of claim 24 in which said joint means include forwardly extending tongues.

26. The structure of claim 24 in which said coupling means includes inwardly extending rails.

27. A wear cap for an excavating tooth comprising unitary metal body having a plate-like top portion equipped with depending side flanges, said side flanges being equipped with inwardly directed rails for coupling the cap to an adapter, said side flanges being equipped with forwardly extending tongues for joining with complementary recesses on a point to stabilize said point on said adapter in resisting the beam component of externally applied forces on said point.

* * * * *